United States Patent [19]

Gould

[11] 4,156,386

[45] May 29, 1979

[54] TRASH COMPACTOR

[75] Inventor: Orval E. Gould, Mission Viejo, Calif.

[73] Assignee: GGC Inc., Santa Ana, Calif.

[21] Appl. No.: 862,955

[22] Filed: Dec. 21, 1977

[51] Int. Cl.[2] ..... B30B 15/30

[52] U.S. Cl. ..... 100/215; 100/229 A

[58] Field of Search ..... 100/229 R, 229 A, 53, 100/215, 216, 255; 141/71, 73, 80; 294/73; 220/1.5; 53/124 B

[56] References Cited

U.S. PATENT DOCUMENTS

| | | | |
|---|---|---|---|
| 2,782,711 | 2/1957 | Heizer | 100/229 R |
| 3,424,078 | 1/1969 | Boyd | 100/215 X |
| 3,463,079 | 8/1969 | Corbett | 100/229 R X |
| 3,611,673 | 10/1971 | Carkhuff | 100/229 A X |
| 3,669,485 | 6/1972 | Stihler | 294/73 |
| 3,765,148 | 10/1973 | Ippolito | 100/229 A |
| 3,831,513 | 8/1974 | Tashman | 100/215 X |
| 3,885,467 | 5/1975 | Merkin | 100/229 A |
| 3,893,387 | 7/1975 | Eckerle | 100/229 A |
| 3,901,139 | 8/1975 | Moriconi | 100/229 A |
| 3,916,782 | 11/1975 | Booton | 100/229 A |

*Primary Examiner*—Billy J. Wilhite

*Attorney, Agent, or Firm*—Gordon L. Peterson

[57] ABSTRACT

As a part of the combination there is provided a trash container of the type which can be picked up and dumped by inverting it by the lift usually found on the front or rear end of a trash collection vehicle. However, because the invention contemplates compaction of the trash in the container before its contents are dumped into the vehicle, the container has flared end walls, such as to permit the compacted contents to fall freely from the container upon its inversion by the vehicle lift. To accomplish the desired in-container compaction, a vertical hydraulically driven ram is mounted in such a way that the container may be placed below it when the ram platen is raised to its first and upper position. Support means are provided for the underside of the container and for its flared end walls when the container is disposed directly below the ram platen, such support means being engaged with upwardly extending means to hold the ram in position above the container for reciprocal movement vertically from its first and upper position above the container, to a second position inside the container and approaching the bottom wall of the container.

7 Claims, 11 Drawing Figures

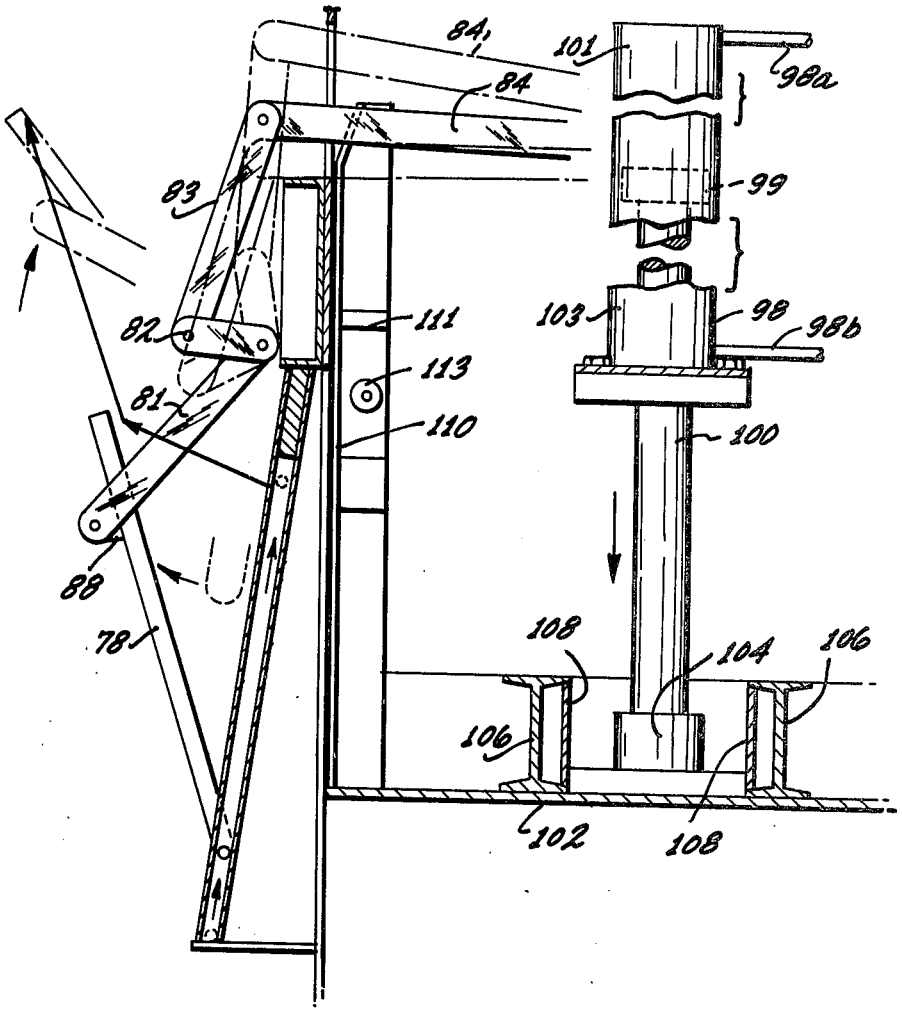
Fig. 5
Fig. 6
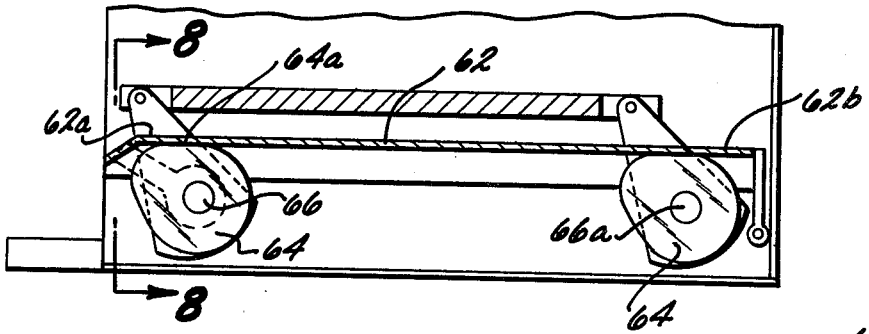
Fig. 8
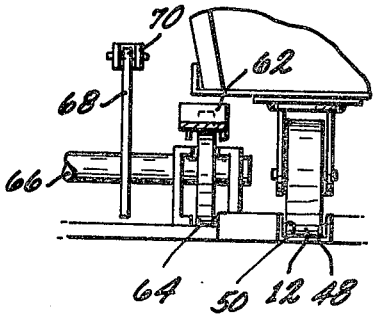
Fig. 7
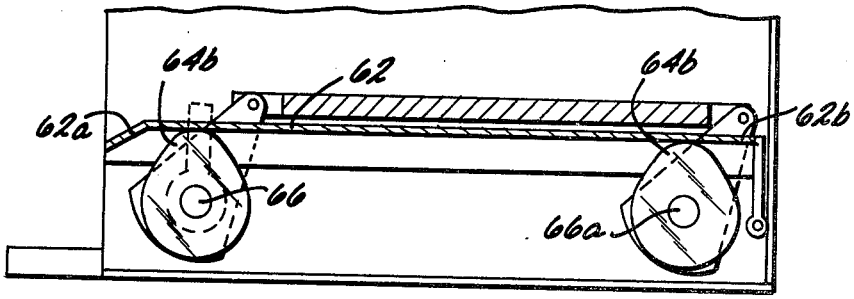

TRASH COMPACTOR

BACKGROUND OF THE INVENTION

1. Field of the Invention

This invention relates to compaction apparatus in general and in particular to such apparatus for use in effecting compaction of refuse in an open top trash container adapted to be picked up by, and its contents dumped into, a lift-equipped trash collection vehicle.

2. Description of the Prior Art

Within the past forty years trash collection and disposition has commanded an ever increasingly greater amount of effort and attention. In recent years more and more articles and food products have been packaged in throw-away containers with the result that an ever increasing amount of trash has been generated. Such increasing volume of trash has mandated its being collected and disposed of by municipalities and private contractors.

A conventional way of handling trash, produced or resulting from the operation of business and commercial establishments, has been to deposit such trash in large mobile bins or trash containers having open tops but provided with hinged lids which may be closed. Periodically, trash collection vehicles arrive at such business or commercial establishments and, through the operation of mechanical or hydraulic lifts with which such vehicles are equipped on either their front or rear ends, the contents accumulated in such bins are dumped into the vehicle housing. Most of such vehicles are equipped with mechanical means to compact least to some extent the bin contents after they are dumped into the vehicle housings. When the trash collection vehicle is filled with its somewhat compacted contents, the vehicle must proceed to a refuse dump.

Among the problems arising from this conventional method of trash collection and disposition are:

1. In establishments the operation of which may generate a large amount of trash or refuse, many bins or containers must always be kept on hand. These containers often occupy a considerable amount of valuable space in a parking or docking area—space which could otherwise be utilized to permit ingress and egress of trucks, or parking by customers and patrons of the business or establishment.

2. It has been known that in some cases employees of a business or establishment may remove from the store, concealed in filled trash containers, certain valuable merchandise. When employees take such filled containers outside for dumping, they do so in a preselected bin or container in the parking lot of the establishment. Subsequently, after the employee has left work, the employee may return to such preselected bin under cover of darkness or otherwise, and pull out from such bin or container the merchandise which he deposited in such bin.

3. Vehicle compactors are ordinarily greatly limited in the force which they can apply to effect compaction with the result that, as bins are dumped into the vehicle housing, only limited compaction of the trash or refuse can actually be accomplished by the vehicle compactor.

4. In establishments in which many bins are employed and are filled regularly, it is necessary to have frequent visits by trash removal vehicles to empty the bins. Since trash removal service contracts usually provide for charges based upon the number of bins used and the frequency of vehicle visits to the establishment's premises to empty the bins, such frequent visits and large number of bins can greatly increase the expense of trash removal.

Another system for accomplishing trash and refuse removal involves the use of what is sometimes called a "roll-off box". The latter is a large open top box which, when filled with trash or refuse, is intended to be hoisted upon some type of truck bed to a landfill where the roll-off container may be unloaded in the same manner as a dump truck. However, where the refuse is uncompacted, such a roll-off box may be quickly filled in any establishment which generates a large amount of trash or refuse. Moreover, the establishment is deprived of the use of the roll-off box during the period when the box is being transported to the landfill for dumping and before it is returned. In addition, this type of system requires a rather special type of truck which has means to hoist the huge elongated box-like container on to the truck bed or chassis, and then to effect dumping of the box at the landfill.

One modification of this system, however, is a compacting box such as is offered by Mid Equipment, Inc. in Grundy Center, Iowa. The Mid Equipment "Super Dock Pack 430" is provided at one end with an arcuate receiving door and a horizontal compactor somewhat similar to the type of compactor which is found in many trash collection vehicles. While this modified roll-off box effects a certain degree of compaction, and thereby diminishes the frequency of the times when the box must be transported to a landfill and emptied, it provides only a limited compaction because the force of the compactor is dissipated against the trash as it accumulates in the full length of the box. In addition, the Mid Equipment packing box is somewhat expensive compared to ordinary containers and does require a special truck for its handling. The system is still subject to the problem of requiring another packing box at the user's premises during the absence of the one box during its transportation to the landfill for dumping.

In addition, Union Hydra-Fab, a division of Union Environmental Corp. in Wayne, Michigan, has devised and offers a container with a built-in horizontal compactor. The entire combination may be lifted up and dumped by a front-end, lift-equipped trash collection vehicle by means of special heavy brackets that the container has built into one of its sides. While such a built-in horizontal compactor can increase the quantity of trash which may be put into the container, the entire unit necessarily becomes quite expensive due to the cost of the attached compactor. Additionally, the container walls must be made much heavier and better reinforced than standard containers in order not to be distorted under the pressure of compaction. Such reinforcement is also necessary so that no distortion of the container occurs when the entire unit, including the attached compactor, is lifted up on to the trash collection vehicle for dumping. Where a single container is sufficient to receive and hold all deposited refuse generated by the establishment during period between arrivals of the trash collection vehicle, such a compactor container combination may offer certain advantages. However, where the establishment generates more refuse than can be handled by a single container, even with compaction, it becomes necessary for the establishment to buy additional expensive compactor-container units to hold its trash between trash removal vehicle visits.

Another system utilized in the collection and disposition of refuse involves a transfer compaction trailer.

This could be a trailer-mounted body having approximately 65 to 75 cubic yards of storage capacity which is attached to a stationary compactor. The charging box of the stationary compactor is loaded with refuse and the compaction ram forces the material into the trailer body. When the trailer body is full, it is hauled to the landfill and a hydraulic ejection blade is actuated which pushes the refuse compacted within the trailer body out through the rear doors of the trailer into the landfill. A special hauling truck is required, however, and at least a second expensive trailer should be available for attachment to the compactor when the other trailer is being hauled to the landfill.

Still another system involves the use of stationary compactors with vertical rams in which the compacted refuse may be baled or otherwise contained into predetermined size packages. The packages, then, may be dumped into some type of container, including conventional open-top bins popularly utilized in commercial and business establishments. Such a system is essentially the same as that employed in many households. Its chief limitation, however, arises from the fact that the compacted refuse mass becomes quite heavy so that when its weight begins to exceed about 60 pounds, personnel involved in transferring the compacted mass into a container bin may find that they are quite strained in their efforts to lift the compacted mass over the side wall and dump it into the bin. Obviously, it would become quite impractical to have any large compactor which would produce a compacted mass weighing much upwardly of 100 pounds.

Thus, it may be seen that there have been various problems and limitations with each of the presently utilized refuse, collection and trash disposal systems.

SUMMARY OF THE PRESENT INVENTION

The present invention improves the efficiency of systems utilizing open-top, bin type containers by enabling them to be filled with well compacted trash and refuse, but without the necessity of compacting such refuse in one location for transfer into the bin. Compaction is effected in the bin or container itself. However, this is accomplished without the necessity of providing thick walls and reinforcements around the outside of the bin to resist the distortion or destruction of the bin which would ordinarily result with conventional thin wall containers where heavy compaction forces are applied vertically within the bin. After the bin of the present invention is filled with compacted material, the bin may be withdrawn from the compactor and placed nearby to await its pick-up by, and dumping into, a trash collection vehicle. In the meantime, an additional relatively inexpensive bin or container may be moved into the compactor for further trash loading and compaction.

With the present system, therefore, a business or commercial establishment will require but a small fraction of the number of conventional bins which it now utilizes, thereby requiring less space in its parking lot to store bins and less bin rental charges, as well as fewer costly weekly visits by a trash collection vehicle.

In addition, when a compactor of the present invention is installed with its loading side accessed directly through an opening in the wall of the building of the business establishment, thefts of merchandise by employees through the trash disposal route as heretofore possible in conventional bin systems, may largely be prevented, since employees have no excuse for carting outside the building any alleged trash which may incidentally include, under the cover trash, any good store merchandise. Should an employee attempt to put any of the latter in the bin under the compactor, the latter would either destroy it or render it unrecoverable later by the employee.

The bins or containers utilized with the present invention vary only slightly from conventional bins in that the end walls of the bin flare outwardly from the bottom wall of the bin. Such flareout is necessary to enable the compacted contents of the bin to fall free when the bin is picked up by the trash collection vehicle lift and turned upside down over the mouth of the trash receptacle housing of the vehicle. Desirably the bottom of the bin or container will be reinforced by a longitudinally extending beam or semi-tubular substrate below the actual container bottom wall. The container of the present invention may otherwise be quite similar to conventional bin type containers as, for example, in overall size, equipped with castered wheels at the bottom for mobility, and provided with hinged lids to cover the top of the container when it is not disposed in the compactor unit itself.

The compactor of the present invention disposes a hydraulic ram to reciprocate along a vertical axis. The bottom end of the ram is capped with a horizontal platen having a rectangular configuration similar to, but dimensioned slightly smaller than, the bottom wall of the container into which the platen is intended to be forced by the ram. Means are provided to support and dispose this ram and its platen at such an altitude that the ram platen, in its upper unextended position, is sufficiently above the level of the top of the bin to enable trash to be deposited in the bin between the upper edge of a side wall of the bin and the bottom of the platen. The support means, moreover, extends around the flared end walls of the bin to provide support against the flared end walls. In addition, elevatable support means are provided which may be brought up to abut and support the end corners of the container bottom, including the ends of the beam or semi-tubular substrate. Thereby, when the ram platen is forced against the trash in the bin to effect compaction, the force of the platen acts against the underlying support means, and not against an unsupported bottom wall of the bin or unsupported flared end walls.

The housing for the compactor, desirably, is provided with a further opening in one of its side walls. This further opening is located slightly above the top of the opening through which the container may be pushed for loading. This further opening enables the container to be loaded with trash or refuse when the platen of the hydraulic ram is retracted to its uppermost position. Desirably also, removable closure means, which may be operated by the downward movement of the compacting ram, are provided to enable this further opening in the side wall of the compactor housing to be closed when loading is not in process or when the compactor is actually being operated, thereby to prevent possible injury to personnel who might happen to be attempting to load trash into the bin when the ram platen is being forced downwardly.

With the present invention a business establishment may be found to employ only a fraction of the number of bins which it would otherwise utilize for the deposit and removal of uncompacted refuse, thereby greatly reducing its costs for a refuse removal. In addition, the present system greatly reduces the number of visits to business establishments which must be made by trash collection vehicles with a general saving in gasoline consumption and air pollution. Further, employee thefts may be effectively prevented. Moreover, in those areas where trash is deposited in a landfill over which dirt will later be placed for a housing development or the placing of other business structures, the costs of compactions of the landfill may be substantially diminished where the fill has consisted of compacted refuse, such as that provided by the present invention.

BRIEF DESCRIPTION OF THE DRAWINGS

FIG. 5 is an enlarged view of a portion of the upper left hand side of FIG. 3;

FIG. 6 is a sectional view looking in the direction of the arrows 6—6 of FIG. 4, but showing the support element in its lowered position;

FIG. 7 is a view similar to FIG. 6, but showing the support element in its raised and supporting position; and FIG. 8 is a further detailed view showing a portion of the area and mechanism for raising and lowering the support element as seen looking in the direction of the arrows 8—8 in FIG. 6.

DESCRIPTION OF THE PREFERRED EMBODIMENT

Figure 3:
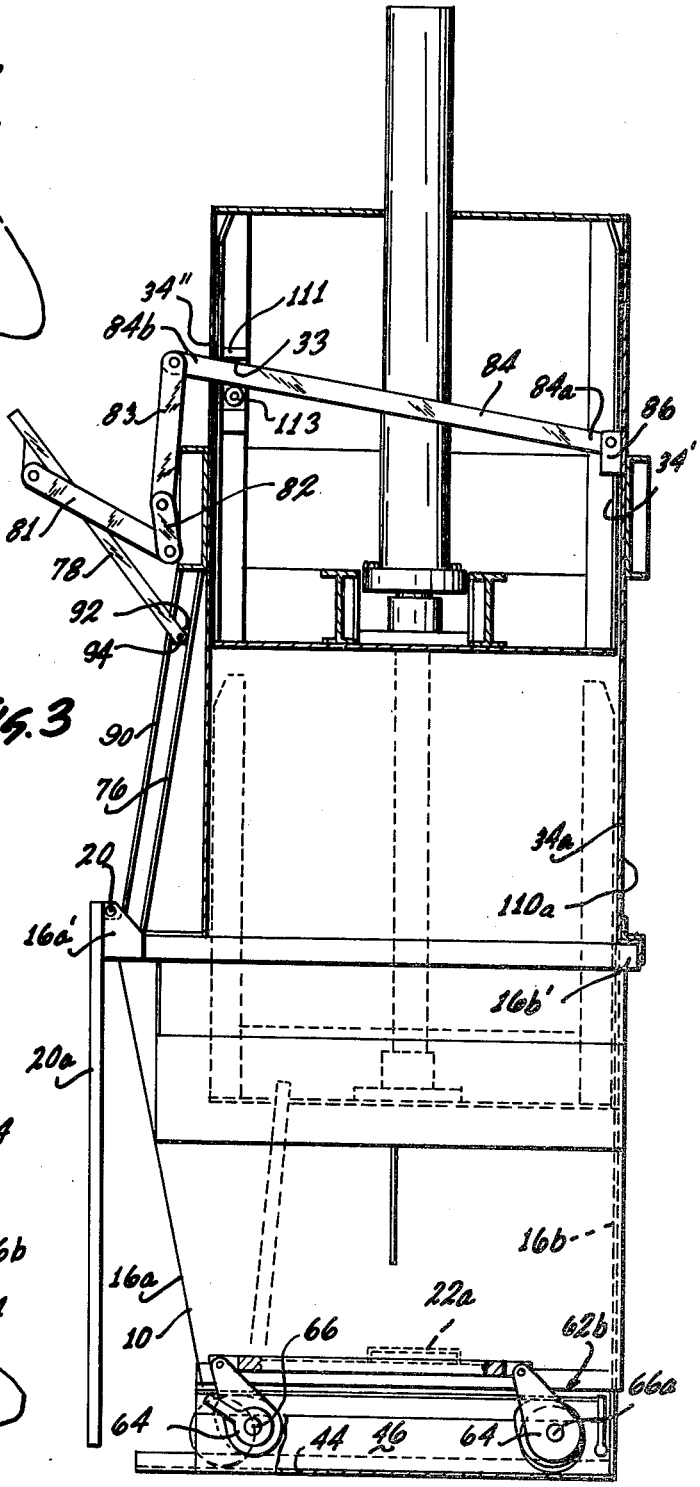
FIG. 3 is an enlarged sectional view taken on the line 3—3 of FIG. 1.
Figure 4:
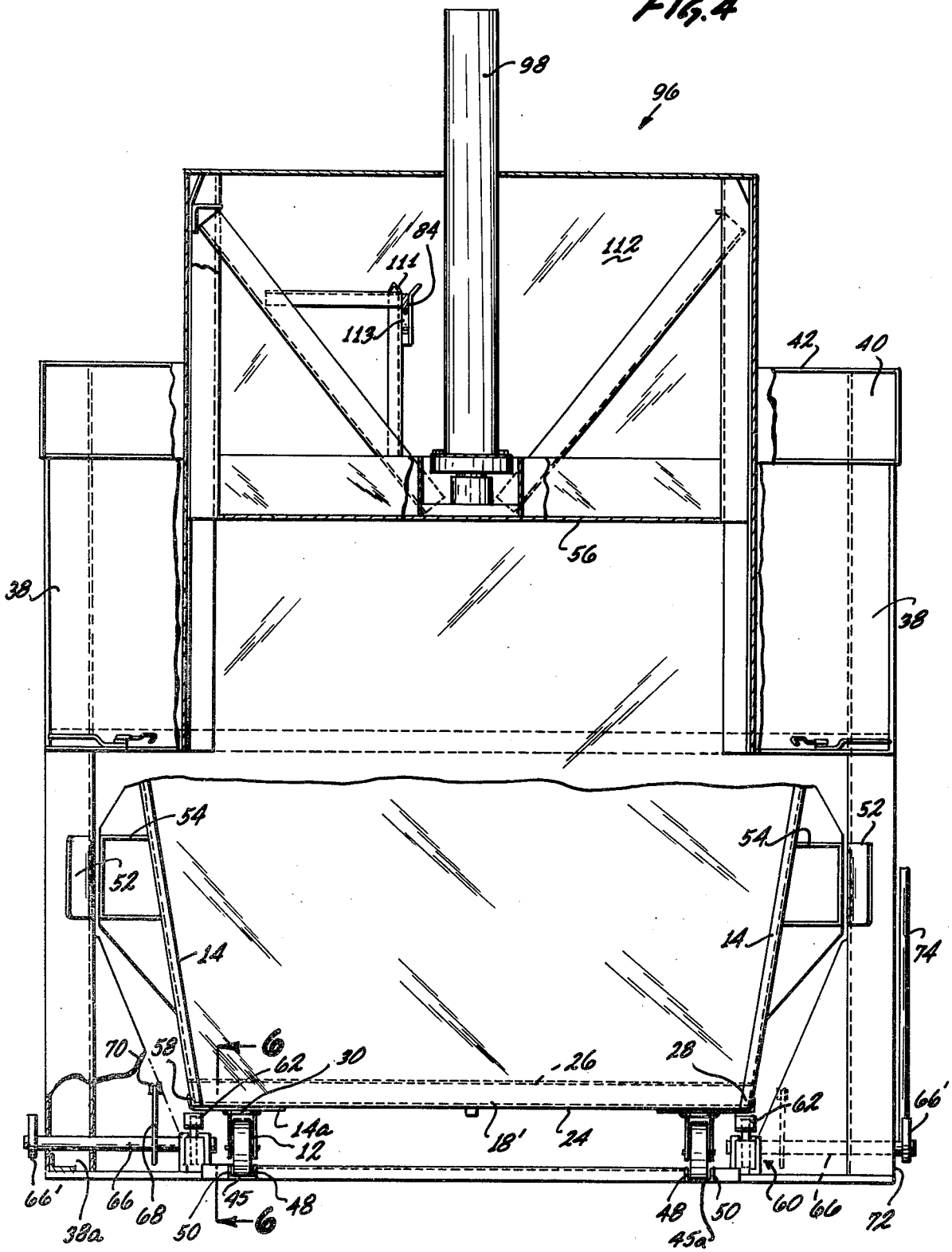
FIG. 4 is an elevational view partly broken away looking in the direction of the arrows on the right side of FIG. 3.

Referring first to FIGS. 3 and 4 of the drawings, it may be seen that the present invention contemplates the use of a mobile bin type container 10 which, in many respects, resembles the large refuse containers which may commonly be found in the parking lots adjacent large grocery chain stores or near the loading docks of commercial and business establishments. Such resemblance arises from the fact that the container 10 is provided on its underside with a pair of wheels 12 and a peripheral wall which includes end walls 14 and side walls 16*a* and 16*b* which are secured to and rise from a bottom panel 18'; and the container 10 is further provided with a pair of lids 20*a* and 20*b* which are hinged at 20 at the upper edge 16*a*' of the wall 16*a*.

Figure 9:
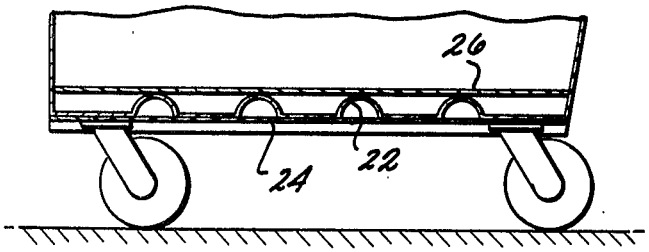
FIG. 9 is an end view of one embodiment of a container.

The container 10 differs, however, from conventional containers in that its end walls 14 flare or angle out upwardly in the manner best shown in FIG. 4. In addition, the side wall 16*a* desirably also flares out slightly toward its upper edge. The bottom panel 18' of the container, moreover, is reinforced to some extent. Such reinforcement may include discontinuities, such as a series of semi-tubular channels 22 formed integrally with the lowermost plate portion 24 when such plate portion is stamped or pressed out (see FIG. 9). Such channels thus extend upwardly to the underside of another plate 26, both of which plates 24 and 26 may thus comprise the bottom panel 18' of the container 10. The channel numbers 22 extend all the way to the ends 28 where they are joined as by welding to the lower portions of the walls 14. Alternatively, as shown in FIGS. 3 and 4, a single wide channel beam 22*a* may be provided to span the container bottom plate from one end 28 to the other end 28. Desirably, the lowermost portions of the walls 14 are bent under plate 24, as at 14*a*, to provide further reinforcement under the ends of the bottom panel 18' in the area in which the wheel trunnions 30 are to be secured.

Figure 2:
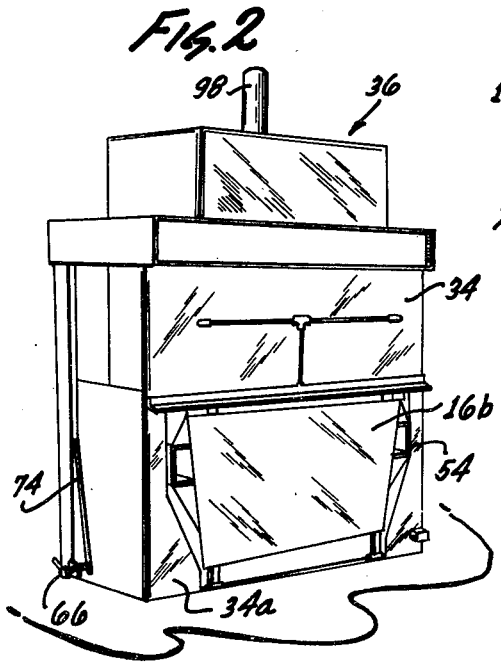
FIG. 2 is a perspective view taken from a side and showing the opposite face of the apparatus.

As may best be seen in FIGS. 2, 3 and 4, this container 10 is received in a trash bin receiving space through an opening 32 in the housing 34 of the compactor unit 36. The compactor housing 34, in the embodiment shown, is generally rectangular in configuration and includes a supporting structure which includes a housing 34, vertical beam corner elements 38 and cross beam members 42 which interconnect the upper extremities 40 of the corner elements 38. The lower extremities 38*a* of the vertical beams 38 are anchored to the corner of the base plate 44 and may be further interconnected by base members 46, which are also anchored to the base plate 44. A member 45, 45*a* may be secured to the base plate along each side edge thereof. Slotting 48 is provided in the base plate 44 and the member 45 to permit the wheels 12 of the container 10 to be rolled into such slotting, thereby to properly dispose the container 10 into the opening 32 in the compactor housing 34 and directly under the ram platen 56. To enable the wheels to be initially guided into the slotting 48, the slotting entrances 50 may be made wider and thereafter gradually narrowed down to just a little wider than the wheel dimension. In addition, further to guide the container into the opening 32 in the housing 34, extending angled plate members 52 may be provided at the level where the container pickup brackets 54 are secured outwardly of the walls 14 of the container 10. The plates 52 may also serve the function of restraining the walls 14 from being forced further apart under the pressure of the compactor platen 56, as hereinafter further explained.

Further, to reinforce the end corners 58 of the container 10 under such compaction pressure, elevatable support means 60 are provided at each end corner 58 of the container 10. As may be best seen in FIGS. 6, 7 and 8, each of such support means may comprise a rigid transverse element or support member 62 which is disposed directly under the end corner 58 of the container and extends the full length thereof. Below each end 62*a*, 62*b* of the element 62, there is provided a cam in the form of an eccentric element 64 fixedly mounted on a shaft 66 or 66*a* to rotate therewith. Also, fixedly mounted on each shaft 66 is a bell crank 68, the upper extremity of which is pivotally secured to another transverse channel element 70, thereby accomplishing a ganging of the two shafts 66 and 66*a*. The outer extremity 66' of one shaft 66 extends outside the end wall 72 of the compactor housing 34 and is provided with a crank handle 74 also fixedly secured to the extremity 66' of the shaft 66. With this arrangement, it may be seen that when the flattened sides of the eccentric elements 64 abut the underside of the transverse member 62, the member 62 occupies its lowered position, which is out of contact with the underside of the end corner 58 of the container 10 so the container 10 can be freely wheeled in and out of the trash bin receiving space without interference from the elevatable support means 60. However, when the eccentric elements 64 are rotated to force their smaller rounded ends 64*b* up against the underside of the transverse member 62, the latter is elevated to where it abuts the underside of the corner 58 to support the container 10 along the edges of the bottom wall 18. Preferably, the elevatable support means 60 in the raised position elevates the wheels 12 of the container 10 above the surface on which the wheels were supported so that the entire container is supported by the transverse members 62. The difference in these dispositions may be seen in FIG. 4, where on the left side, the member 62 is in its lowered position, while on the right side, the member 62 has been elevated to its raised position by the turning of the crank handle 74.

Figure 1:
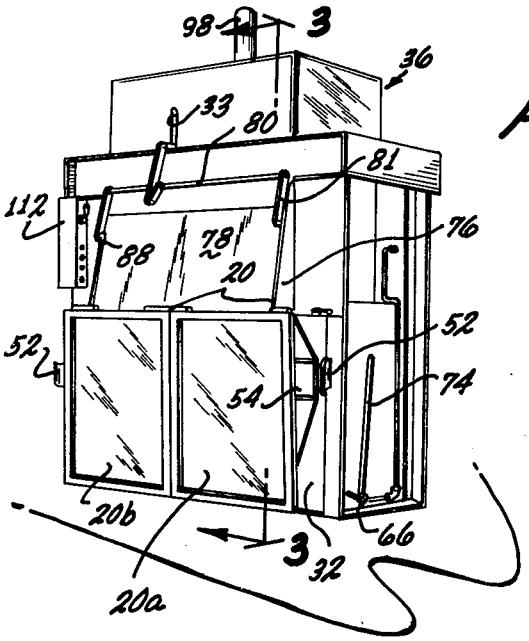
FIG. 1 is a perspective view of the preferred embodiment of the invention taken from one side thereof and showing the loading face of the apparatus.

It will be observed in FIGS. 1, 3 and 4 that, on the loading face side of the compactor housing, a second opening 76 is provided above the opening 32 in which the container or bin is received. This opening 76 is provided with a closure panel 78 which may be swung upwardly and outwardly by a plurality of actuated articulated elements 81,82,83 and 84. Element 84 may be pivotally anchored to the inside of housing wall 34' by its extremity 84*a*, its other extremity 84*b* extending through a slot 33 in the upper part of the compactor housing wall 34" for pivotal connection in series with the other elements 80,81,82 and 83. Actually, two elements 81 are provided, one at each end of the closure panel 78. One extremity of each element 81 is pivotally connected to the panel 78 by a trunnion 88 while the other extremity of the element 81 is interconnected to the corresponding extremity of the other element 81 by means of the transverse shaft member 80. Channel members 90 may be provided on each side of the panel member 76. The function of these channel members 90 is to receive and retain slidably within such channel member a block 92 onto which a pin 94 extending outwardly from the end of the panel member 78 may be pivotally mounted.

Compaction is accomplished in the bin by a hydraulically powered vertical compactor element 96 which comprises drive means in the form of a hydraulic cylinder 98 in which a hydraulic ram 100 is reciprocated vertically along a path in accordance with the application of hydraulic fluid to the chamber on one side 101 or the other 103 of the piston 99 disposed on the upper end of the ram 100 in the cylinder 98. The ram 100 is movable between a retracted position shown by full lines in FIG. 3 in which the ram is above the trash bin receiving space and an extended position shown by dashed lines in FIG. 3 in which the ram is in the trash bin receiving space. The lower extremity of the ram is capped by, and includes, a horizontal piston 56 having a configuration similar to the bottom wall 18 of the container but with dimensions slightly less than such bottom wall. This piston 56 desirably may itself comprise a rigid steel plate 102, secured in a horizontal position by a cap 104 on the end of the ram and braced by a pair of I-beams 106 and inner plates 108. Desirably, side walls 110,110*a* and end walls 112,112*a* may extend upwardly from, and be carried by, the plate 102. Side wall 110 may be slotted in registry with slot 33 in the compactor housing wall 34" and carry a bracket 111 on which is mounted a transverse roller 113 in alignment with the element 84.

Figure 10:
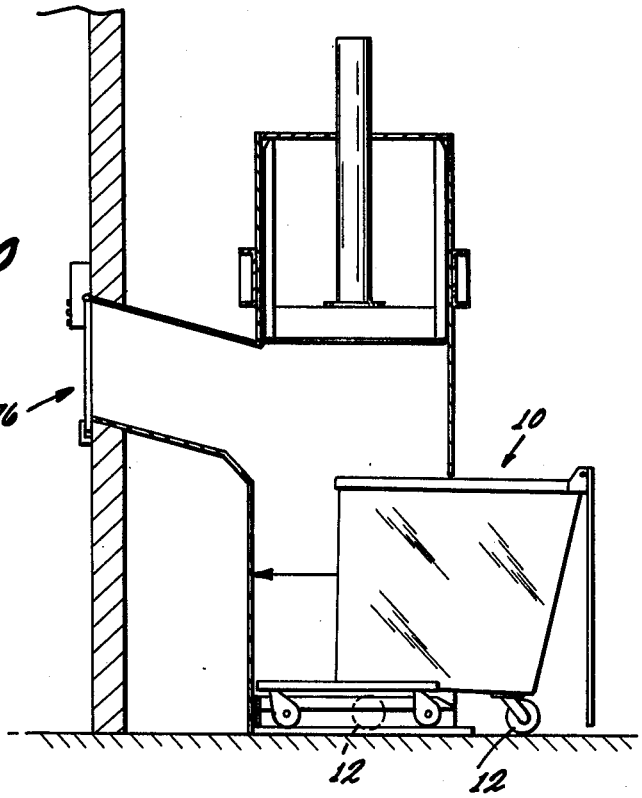
FIG. 10 is a schematic view of an embodiment of the invention adapted for direct loading from inside a building.
Figure 11:
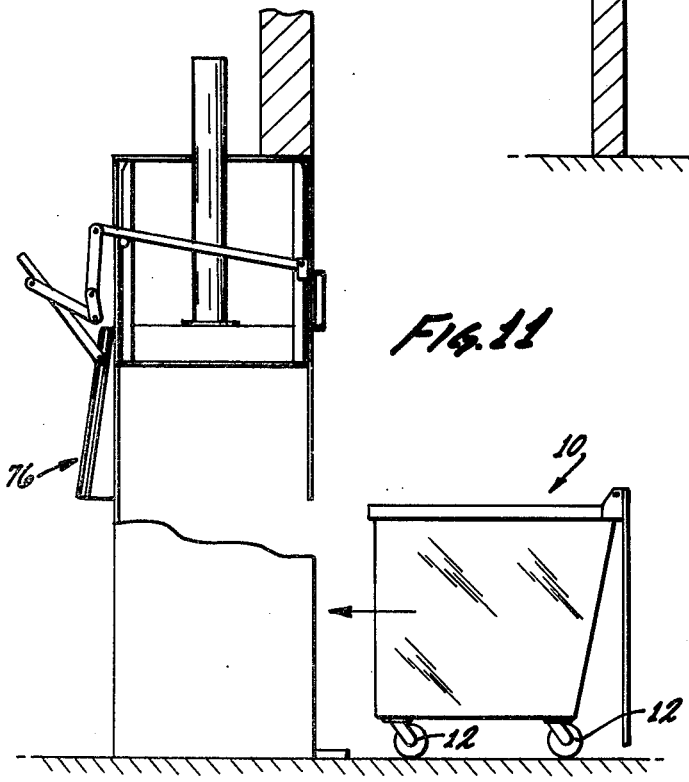
FIG. 11 is a schematic view of an embodiment of the invention wherein the compactor housing is built into the wall of a building.

In use, a compactor of the present invention would preferably be installed, as illustrated in FIG. 11, with at least a portion of its housing built into the wall of a store or other establishment building in the area in which refuse is mostly collected so that the refuse loading opening 76 is actually within the store or establishment building while the container entrance opening 32 in the housing 34 is either flush with the building wall or projects outwardly therefrom. In this connection, it should be pointed out that each of the container entrance opening 32 and the refuse loading opening 76 may be disposed on either face of the housing 34, as for example, both on the same face as shown in FIGS. 1, 3 and 4 or on opposite sides as shown in FIGS. 10 and 11. Desirably, the base of the compactor housing should be disposed on the level of a parking lot or other decking on which refuse containers would normally be disposed and from which they would be picked up and dumped by a trash collection vehicle. A bin or container 10, constructed in accordance with the present invention, would be rolled on its wheels 12 into the slotting 48 in the base plate 44 and member 45 of the compactor housing 34, and the container 10 then pushed into the opening 32 until the container side wall 16*b* is substantially flush with the wall 34*a* of the compactor housing 34 and its leading upper rim 16*b'* contacts stop member 110, thereby positioning the container properly in the housing opening 32 for compaction by the ram 100. Before pushing the container 10 into the opening 32, however, the container lids 20*a* and 20*b* should be swung back to where they are disposed in the open position shown in FIGS. 1 and 3. Also, of course, the compactor ram 100 is moved upwardly to its first and uppermost position shown in full lines in FIGS. 3 and 4. As the ram 100 is so moved upwardly, the roller 113 will lift the element 84, thereby causing the closure panel 78 to be lifted upwardly from its closed position shown in FIG. 1 by the other articulated elements 80,81,82 and 83. The open space 76 is thus exposed directly above the rim 16*a'* of the wall of the container 10 for trash deposit access. Trash may then be deposited through the opening 76 and opened top of the container 10 until the trash reaches a level approaching the rims 16*a'* and 16*b'* of the container walls 16*a* and 16*b*, whereupon a switch on the panel 112 may then be actuated to pump hydraulic fluid through the line 98*a* to force the piston 99 downwardly in the cylinder 98 to drive the ram 100 and its plate 102, comprising the piston 56, downwardly within the container to the position shown in dotted lines in FIG. 3, or lower to effect a compacting of the trash deposited within the container 10. Simultaneously, with the initial downward movement of the plate 102, the element 80 which is supported in its raised position by the roller 113, drops with the roller 113 to the bottom of the slot 33 by virtue of the weight of the closure panel 78 acting upon the articulated elements 81,82,83 and 84. The closure panel 78 is thus brought down to close the opening 76 during the initial portion of the downstroke of the ram. If the closure panel 78 does not fully close, the ram is returned to the uppermost position. This can be brought about in various different ways, such as by use of passenger elevator-type controls which prevent elevator operation when the elevator doors are open.

Before the ram and its platen are thus brought down, however, the operator should pull the handles 74 on opposite ends of the compactor housing 34 to raise the reinforcing support elements 62 to the position shown on the righthand side of FIG. 4. With such reinforcement provided on the corner edges 58 of the bottom of the container and the semi-tubular supports sandwiched in effect between the walls 26 and 24, the container bottom is enabled to withstand the platen compaction pressure exerted against it through the accumulated refuse in the container as such refuse is flattened by the downward movement of the ram platen 56 against the trash or refuse in the container.

After compaction has thus been effected, another switch on the panel 112 is actuated, thereby to cause fluid in the upper chamber 101 of the hydraulic cylinder 98 to pass out of that chamber through the line 98*a* into a reservoir (not shown). Simultaneously, fluid is forced through the duct 98*b* into the lower chamber 103, thereby forcing the piston 99 upwardly to bring the ram and its platen back to its first and upper position and simultaneously reopening the panel 78. More trash or refuse may then be deposited through the opening 76 into the container on top of the theretofore compressed trash or refuse. The process, thus, may be repeated until the container is filled with compacted trash to the level of the wall rims 16*a*′ and 16*b*′. Thereupon, the container 10 is rolled out of the opening 32, its lids 20*a* and 20*b* are then flipped upwardly and back over the top of the container to close the same, and the container 10, thus filled with compacted trash, is pushed aside to await the arrival of, and dumping by and into, a trash collection vehicle. In the meantime, a second container of identical construction is rolled into the opening 32 for further loading of trash and compaction in the container in the manner just described.

It will be found that, with a platen which can apply an appropriate amount of pressure to trash deposited in the container, the container can be made to receive and retain somewhere between six and twelve times (depending upon the nature of the trash) the amount of trash which would otherwise be depositable in a conventional trash container of the same cubic yardage. Thus, a store, business or commercial establishment will find that it needs only one-sixth to one-twelfth the number of trash containers which it has been requiring to take care of its trash collection and disposal. Thereby, the user effects a considerable saving in its cost of renting containers, and in having them picked up and emptied. In addition, there is further extensive saving in the spacerequired by the establishment for the storage of such containers before and after filling them and awaiting pickup and emptying by the trash collection vehicle which services the establishment.

When the trash collection vehicle arrives, it may simply insert its forks through the brackets 54, elevate and invert the container 10 over its trash receiving area, and dump the compacted contents into the vehicle trash collection housing. Since the vehicle housing is then receiving only compacted trash, it will be found that the vehicle actually carries many times the tonnage of trash which it would otherwise carry when it receives the trash in uncompacted form and some compaction is effected through a mechanical compactor which may be incorporated in the trash collection vehicle. In this manner, a considerable saving is effected in the number of trips which the trash collection vehicle is required to make between an establishment and a landfill deposit to the economic benefit of the trash collecting organization, its customers or both.

Although an exemplary embodiment of the invention has been shown and described, many changes, modifications and substitutions may be made by one having ordinary skill in the art without necessarily departing from the sprit and scope of this invention.

I claim:

1. A trash compactor for compacting trash which has been collected in a trash bin, said compactor comprising:

a supporting structure having a trash bin receiving space into which the trash bin can be placed, said supporting structure including a housing having an opening on the housing periphery through which trash can be deposited in the trash bin in the trash bin receiving space;

a door movably mounted on said supporting structure for opening and closing said opening;

a ram;

means for mounting said ram on said supporting structure for generally vertical movement along a path between a retracted position in which the ram is above said trash bin receiving space and an extended position in which the ram is in said trash bin receiving space;

drive means for reciprocating the ram along said path;

elevatable support means in said trash bin receiving space for selectively supporting the trash bin in said trash bin receiving space from below;

said elevatable support means including a support member and means for raising and lowering said support member whereby when the support member is lowered, the trash bin can be moved into the trash bin receiving space without interference from the support member and then raised to support the trash bin from below during compaction of the trash therein;

means for automatically closing said opening with said door at least when the ram is in said extended position; and said automatic means includes a link pivotally attached to the supporting structure and said ram includes a peripheral wall, said link being engageable with and pivotable by said peripheral wall of said ram as the ram moves along at least a portion of said path, and linkage means responsive to the pivotal movement of said link to move said door to open and close said opening.

2. A trash compactor as defined in claim 1 wherein said raising and lowering means includes cam means rotatably mounted on said supporting structure and supporting said support member, said cam means being rotatable to raise and lower the support member.

3. A trash compactor as defined in claim 1 wherein said raising and lowering means includes a plurality of rotatably mounted cams and manually operable means for rotating said cams to raise and lower the support member, said support member resting on said cams.

4. A trash compactor as defined in claim 1 wherein said supporting structure includes wall supporting means for engaging and supporting the peripheral wall of the trash bin in the trash bin receiving space at least during compaction of the trash in the trash bin.

5. A trash compactor as defined in claim 1 wherein said raising and lowering means includes cam means rotatably mounted on said supporting structure and supporting said support member and manually operable lever means for rotating said cam means to raise and lower the support member, said supporting structure including wall supporting means for engaging and supporting the peripheral wall of the trash bin in the trash bin receiving space at least during compaction of the refuse in such trash bin.

6. A trash compactor as defined in claim 5 including means defining tracks in said trash bin receiving space with the tracks being adapted to receive wheels of the trash bin to at least assist in positioning the trash bin within the trash bin receiving space.

7. A trash compactor as defined in claim 1 wherein said supporting structure includes a housing and a chute is provided leading from the interior of a building to a location in said housing above the upper end of the trash bin whereby trash can be placed in the trash bin within the compactor from within the building by depositing the trash in the chute.

* * * * *